US006712118B2

(12) United States Patent
Nussdorf

(10) Patent No.: US 6,712,118 B2
(45) Date of Patent: Mar. 30, 2004

(54) PORTABLE EXHIBITION FRAME ASSEMBLY

(76) Inventor: Jeffrey Mark Nussdorf, 1605 Entrada Diez, Tucson, AZ (US) 85718

( * ) Notice: Subject to any disclaimer, the term of this patent is extended or adjusted under 35 U.S.C. 154(b) by 0 days.

(21) Appl. No.: 09/976,379

(22) Filed: Oct. 11, 2001

(65) Prior Publication Data

US 2003/0070770 A1 Apr. 17, 2003

(51) Int. Cl.[7] ..... A47G 5/00

(52) U.S. Cl. ..... 160/351; 40/605; 52/239

(58) Field of Search ..... 160/135, 351, 160/368.1; 40/605; 52/239

(56) References Cited

U.S. PATENT DOCUMENTS 5,187,908 A * 2/1993 Losensky
5,664,380 A * 9/1997 Hsueh
6,141,926 A * 11/2000 Rossiter et al.
6,161,320 A * 12/2000 Peterson

* cited by examiner

*Primary Examiner*—Blair M. Johnson

(57) ABSTRACT

A knockdown portable exhibition frame assembly as an alternative delineation system used for display purposes at trade shows and special events. Fabric sheet material with an enlarged portion is slipped into a horizontal channel at the top and attached to the bottom channel providing a flat taut wall providing a area for display of graphics and products. Horizontal members are releasably attached to vertical posts to form a frame for the fabric sheet material.

5 Claims, 4 Drawing Sheets

PORTABLE EXHIBITION FRAME ASSEMBLY

BACKGROUND OF INVENTION

Basic standards and rails [known in the exhibition industry as pipe and drape] are supplied by exhibition decorating firms, contracted by exhibition management, to delineate space providing various companies an area to display their goods or services. In many cases, companies will provide their own exhibition display that is erected within the space provided. At most exhibition halls in the United States, professional labor to install and dismantle these displays is required by exhibition management or union regulations. This procedure becomes expensive and time consuming to the exhibiting company. Their option is to ship their own display to fit in the space or to utilize the pipe and drape delineator provided. If they attempt to utilize the pipe and drape to display graphic signs and/or products, it ends up looking unprofessional and stresses the structure, which was not designed for this purpose. A new system has been devised to provide an alternative delineator that exhibition management can offer the exhibiting companies upon which products and accessories can be affixed to.

SUMMARY OF THE INVENTION

It is the basic feature of this present invention to provide a structural frame assembly that has a taut fabric wall as a display area allowing light weight graphics and products to be affixed to. It is a further feature of this present invention to complement the basic frame assembly with selective options, such as lighting, headers, side rails, product mounting systems and varied configurations permitting expanded display areas for double-side presentation. The options are specifically designed to allow the, exhibiting company to customize the invention to meet their specific requirements.

The invention features generic top and bottom channels that fit into vertical support tubes allowing the assembly to connect in a continuous row providing multiple booth spaces. It is a further feature of this present invention to utilize different sizes and configurations depending upon the customer requirements.

In order that the invention be more clearly understood, it will be disclosed in greater detail with reference to the accompanying drawings.

BRIEF DESCRIPTION OF THE INVENTION

DETAILED DESCRIPTION OF THE INVENTION

Figure 1:
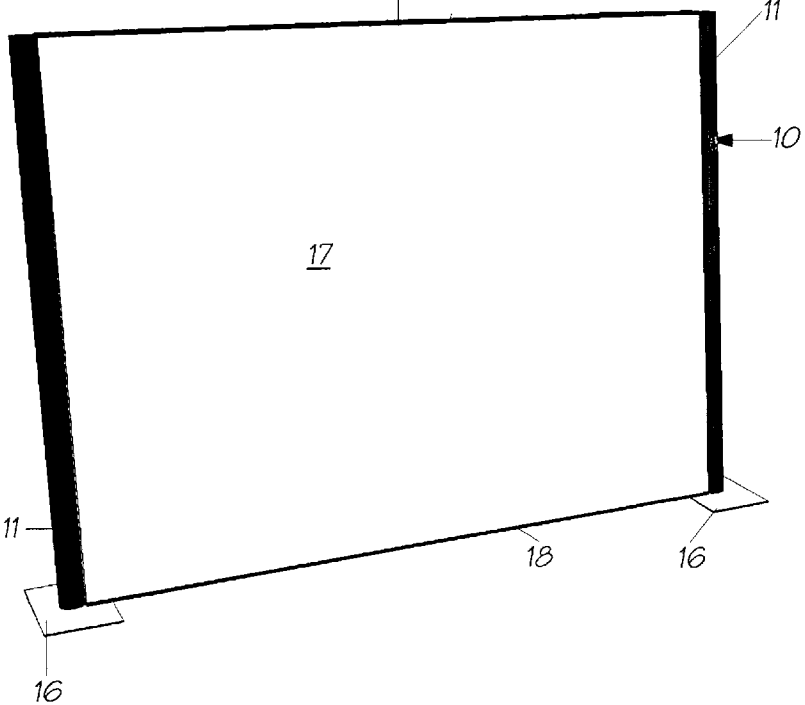
FIG. 1 is a perspective view of the basic portable exhibition frame assembly in accordance with the teachings of the present invention.
Figure 4:
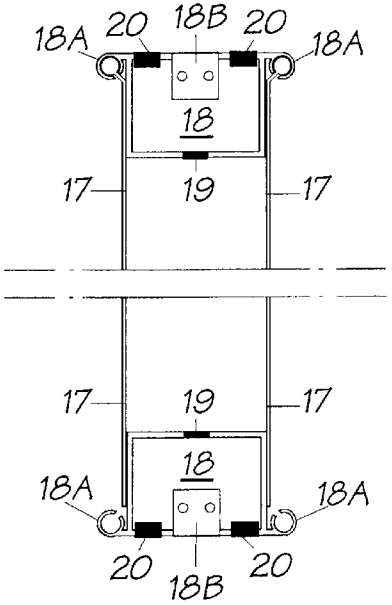
FIG. 4 is a detailed partial sectional end view, reference
Figure 5:
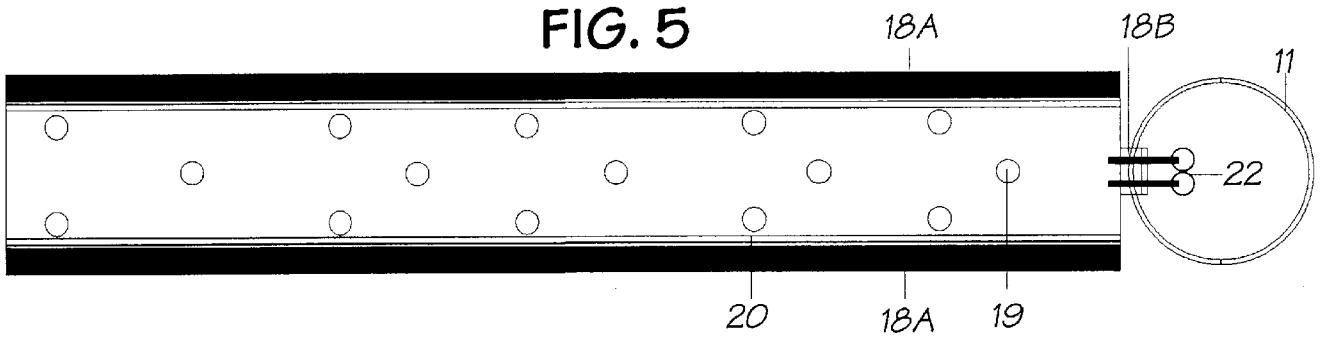
FIG. 5 is partial plan view in wire form showing the top channel connecting with support tube
Figure 6:
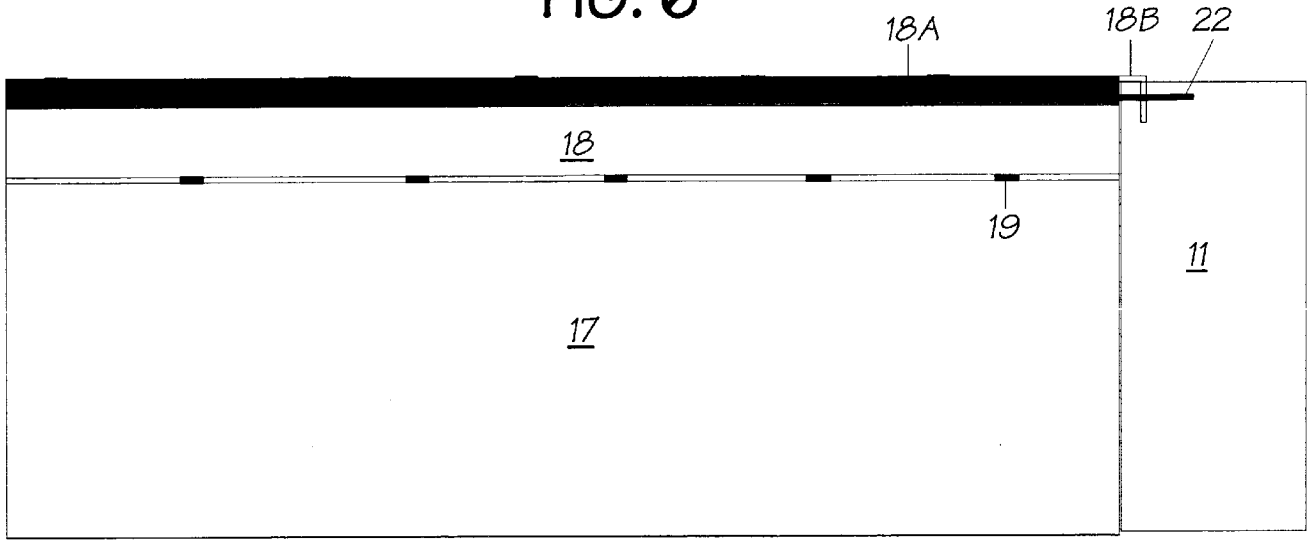
FIG. 6 is a partial side view in wire form showing how the top channel connects with support tube
Figure 7:
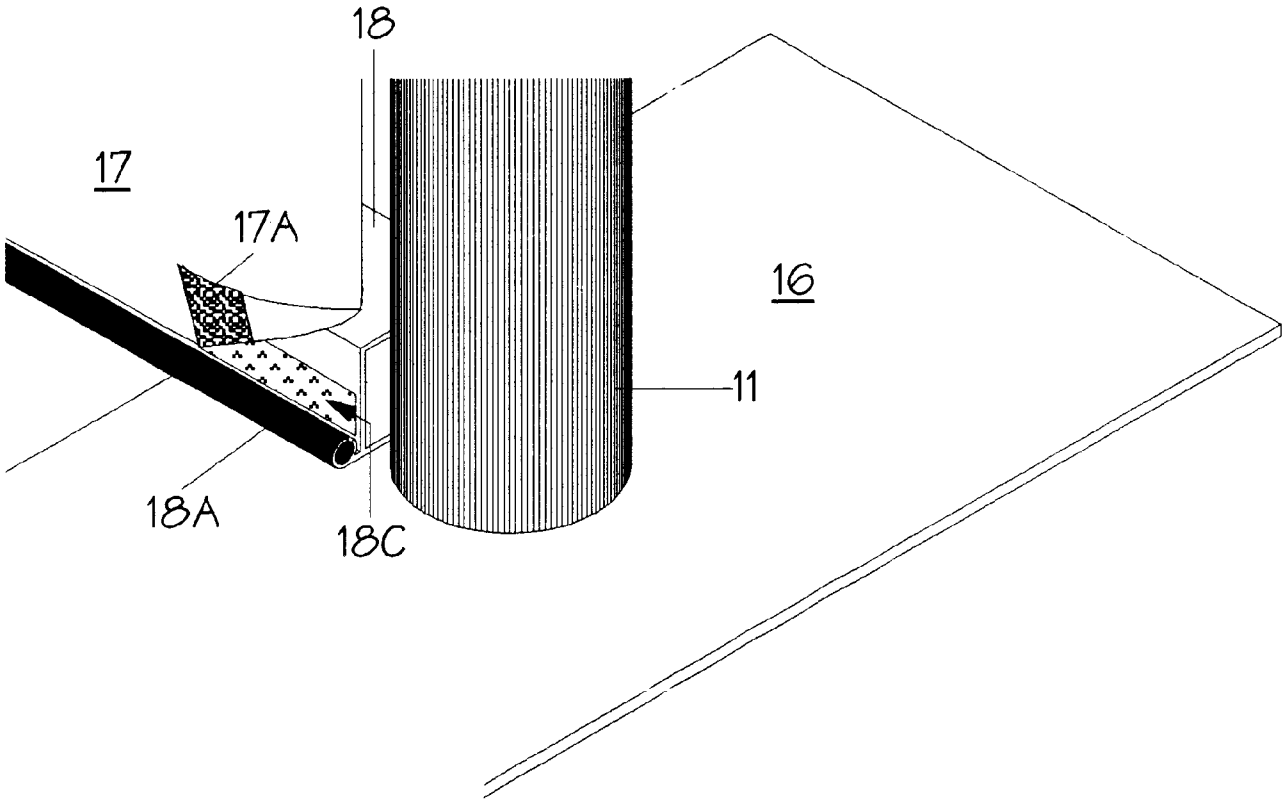
FIG. 7 is a partial perspective view showing how the fabric attaches to the bottom rail with separable fasteners.

Referring to FIG. 1, the portable exhibition frame assembly referred to generally by the numeral 10, is shown as single-sided unit, however; it should be understood that the configuration may be in the alternative, a single-sided fabric backdrop, double-sided backdrop, or a series of interconnected joining booths or back to back booths, as well as other configurations.

Figure 2:
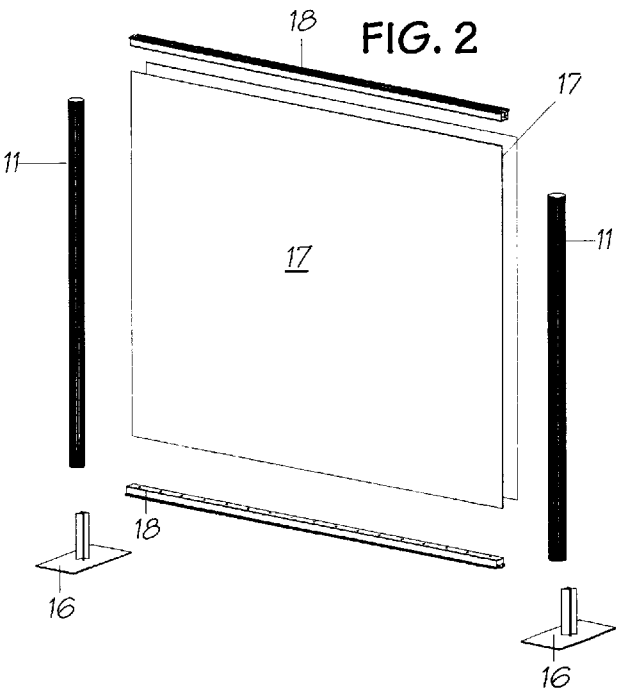
FIG. 2 is another perspective view showing the components detached from its completed assembly.
Figure 3:
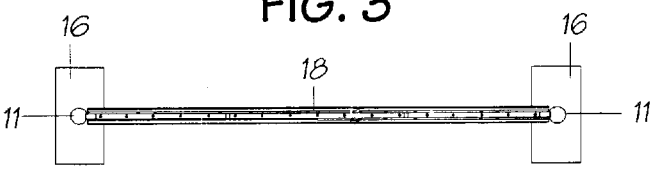
FIG. 3 is the plan view of the assembled unit.

FIG. 2, shows the basic components in a separated format indicating the locations of attachment. The base plates 16 are placed on the floor delineating space in a single booth format with the bottom channel 18 determining the exact spacing between base plates 16 however; if continued in an interconnecting format, one of the base plates would be common to the next booth. The connecting channel rail 18 is generic and is used at the top and bottom. Once bottom channel rail 18 and base plates 16 are in place, the vertical support tubes 11 are slipped over the extension section of channel base plates 16 and the inverted "L" tab of 18 being positioned in place by a gravity fit. The top channel 18 is positioned over both support tubes 11 by a gravity fit. Once in place, two support pins FIG. 5, FIG. 6 and FIG. 8, 22 slip into positioning holes into the top channel "L" tab 18B through positioning holes in support tubes 11.

Figure 8:
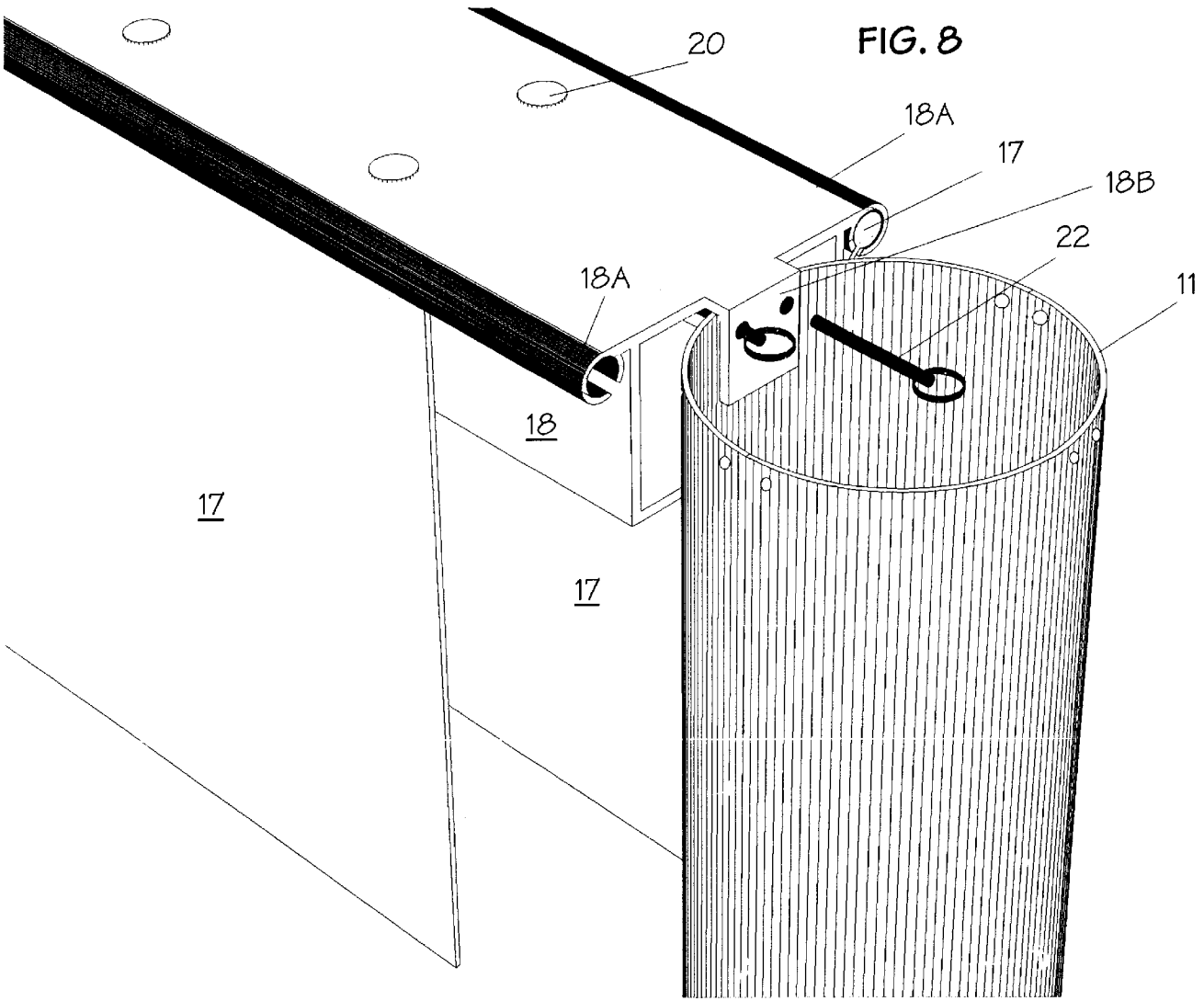
FIG. 8 is a partial perspective view of top channel connected to the support tube.

With the basic components assembled as described herein before, the fabric backdrop 17 has enclosed portion (FIG. 8) which is slipped into the top channel rail conduit flange FIG. 8, 18A spanning the length of the channel rail 18. Once backdrop fabric 17 is securely hanging from channel rail conduit flange 18A, you grasp the center bottom of backdrop fabric 17 pulling in a downwardly direction and when taut, attach the 17A to the vertical face side of the bottom channel 18 with corresponding pressure engaged separable fasteners 18C. The fabric backdrop bottom 17 continues to be pulled taut and pressed to the back continuing left and right along the bottom channel 18 until the entire fabric 17 is secured by a pressure engaged separable fastener 18C, providing a flat taut display backdrop.

The holes 19 and 20 indicated in FIGS. 4, 5, 6 and 8 are for various mounting locators for selective options i.e. light bars, gridwall, light boxes, monitors and other display enhancing items that can be attached to the locators. The mounting locators 20 have threaded inserts providing for easy attachment of accessories as required. Mounting locator holes 19 do not have threaded inserts and are positioned in the center of the channel rails 18 where various typical bolts can be attached for mounting of customer products and/or additional accessories.

Although one embodiment of the present invention has been disclosed and described, it will be apparent that variations and modifications may be made therein without departing from the spirit and scope of the invention as defined in the following claims.

What is claimed is:

1. A portable exhibition frame assembly for delineating an area comprising a pair of laterally spaced vertical tubes, which are detachably connected to base plates, a pair of identical horizontal channel rails detachably connected to and extending between respective top and bottom portions of said support tubes, thereby defining the area, each channel rail having L-shaped tabs on opposite ends thereof with the bottom channel rail placed and positioned to set on said base plates and with a leg of said tab extending upwardly into the bottom of a respective said tube, the top channel rail positioned parallel to said bottom rail but juxtaposed and resting on top of said support tubes with a leg of said tab extending downwardly into the top of a respective support tube creating a frame, said tabs of said upper channel rail being connected to the support tubes by releasable fasteners accessible from within said tubes and extending through aligned holes in said tubes and tabs, the assembly accepting at least one fabric backdrop attached to said top channel rail conduit flanges front and/or back, with a bottom of said fabric attached to said bottom channel rail front and/or back, creating a flat, taut fabric display area on the front and/or back of the assembly, which can then be interconnected with respective channel rails, support tubes and base plates, delineating the space front to back or side to side.

2. The assembly as claimed in claim 1 wherein said vertical support tubes, slip over vertical extensions of weighted base plates providing for a gravity friction fit.

3. The assembly as claimed in claim 1 wherein said horizontal channel rails are identical, with the bottom channel rail positioned between and on top of said base plates, allowing the vertical support tubes to fit over base plate extension, while locating the vertical support tubes over a upwardly extending leg of said tabs located at respectible ends of the channel rail, securing the bottom section of assembly in place with a gravity fit.

4. The assembly as claimed in claim 1 wherein said horizontal channels are identical, with the top channel positioned between and over said support tubes, with the downwardly extending legs of said tabs at respective ends of the channel rail, extended into the vertical tubes and secured by two pins, which are inserted through holes in said support tubes, lining up with the corresponding holes in said tabs, connecting the backdrop frame portion of the assembly together.

5. The assembly as claimed in claim 1 wherein said fabric backdrop has an enlarged portion located at the top of said fabric, providing a stiffening member of the said fabric backdrop into said channel rail shaped conduit flange providing for securing a downward tension pulling of said fabric, while the bottom of said fabric has a has a the reverse bottom side of said fabric, allowing it to attach to the bottom channel rail, which has a corresponding portion of the pressure engaged separable fastener, attached to it, providing for a flat taut fabric display area.

* * * * *